United States Patent [19]

Howarth et al.

[11] Patent Number: 4,703,464

[45] Date of Patent: Oct. 27, 1987

[54] PERMANENT MAGNET BIASED MAGNETOSTRICTIVE TRANSDUCER

[75] Inventors: Thomas R. Howarth, Portsmouth; Peter F. Flanagan, Cranston; William J. Harrold, Kingston; Kenneth Rodberg, East Providence, all of R.I.

[73] Assignee: Raytheon Company, Lexington, Mass.

[21] Appl. No.: 732,332

[22] Filed: May 10, 1985

[51] Int. Cl.[4] ..... H04R 15/00

[52] U.S. Cl. ..... 367/156; 310/26; 367/168; 381/190

[58] Field of Search ..... 367/156, 168, 184, 185; 179/110 C, 114 R, 117; 310/26; 340/854; 335/215, 302, 306; 381/190

[56] References Cited

U.S. PATENT DOCUMENTS

| | | | |
|---|---|---|---|
| 2,421,263 | 5/1947 | Herbst | 367/156 |
| 2,437,270 | 3/1948 | Peek | 367/168 |
| 2,468,837 | 5/1949 | Peek | 367/168 |
| 2,607,814 | 8/1952 | Bloch | 310/26 X |
| 3,418,613 | 12/1968 | Trikilis | 335/302 X |
| 3,721,189 | 3/1973 | Bray | 335/306 |
| 3,783,505 | 1/1974 | Schoen | 335/215 X |
| 4,394,754 | 7/1983 | Waters | 367/184 X |
| 4,438,509 | 3/1984 | Butler et al. | 367/168 X |

FOREIGN PATENT DOCUMENTS

| | | | |
|---|---|---|---|
| 635705 | 4/1950 | United Kingdom | 367/168 |
| 265335 | 3/1970 | U.S.S.R. | 310/26 |
| 303676 | 5/1971 | U.S.S.R. | 310/26 |

OTHER PUBLICATIONS

Smith et al., "Design of a Transducer using Rare-Earth Magnetostrictive Materials", U.S. Navy Journal of Underwater Acoustics, v. 27, #1, 1/77.

Butler et al., "Rare Earth Iron Octagonal Transducer", J. Acoust. Soc. Am. 67 (5), May 1980.

Akervold et al., "Rare-Earth Magnetostrictive Transducer and Material. . .", U.S. Navy J. of Underwater Acoustics, v. 27, #1, 1/77.

*Primary Examiner*—Deborah L. Kyle

*Assistant Examiner*—John E. Griffiths

*Attorney, Agent, or Firm*—Martin M. Santa; Richard M. Sharkansky

[57] ABSTRACT

A transducer which uses paramagnetic magnetostrictive rods or bars, e.g., compositions of the lanthanide series of elements such as $Tb_{0.3}$ $Dy_{0.7}$ $Fe_2$, has the bars biased with a lengthwise flux by a permanent magnet, e.g. samarium-colbalt, of high resistance to demagnetization by the alternating field applied to the bars by alternating current in a coil surrounding the bar. The magnet is outside the coil to reduce the ac field to which it is subjected. Uniformity of flux density along the length of the bars is enhanced by having adjacent ends of the bars subjected to like-polarity poles of the permanent magnets associated with each bar.

21 Claims, 3 Drawing Figures

PERMANENT MAGNET BIASED MAGNETOSTRICTIVE TRANSDUCER

BACKGROUND OF THE INVENTION

This invention relates to transducers and more particularly to magnetostrictive transducers using permanent magnets to provide a magnetic bias field to lanthanide series magnetostrictive drive elements.

Magnetic polarization of magnetostrictive materials is required in order to provide linear frequency operation and to utilize the maximum strain capabilities of the material. In the absence of biasing the output signal frequency is twice the input drive frequency due to the fact that in any magnetostrictive material the strain is either positive or negative regardless of the polarity of the drive signal. Therefore, the absence of biasing causes the transducer's electromechanical coupling coefficient and its resulting efficiency to be very low.

Magnetostrictive materials such as nickel and Permendur materials were commonly used as driving elements in transducers prior to the development of piezoelectrically polarized titanates. Prior to 1946, magnetostrictive ring transducers were not area or mass loaded, instead their ac excitation and dc polarization coils were toroidally wound on laminated ring stacks or scroll-wound continuous strips of nickel or Permendur. Permanent magnets were rarely used to series bias magnetostrictive ring or loop structures having uniform cross-sectional area. Those ring and loop structures that were biased with permanent magnets, usually Alnico-5 or sintered iron-oxide magnets, used magnets of cross-sectional areas greater than that of the magnetostrictive material. These particular magnets were the best available but were easily demagnitized by alternating signal flux densities. The magnets of these prior state of the art art designs did not require special shaping to concentrate the flux distribution through the magnetostrictive element because the permeability of the magnet was much lower than that of the magnetostrictive element. The air gap between the magnet and the magnetostrictive element had to be minimized which meant that the magnet was typically mounted adjacent to the element, and the excitation coil would then encompass the magnet and the magnetostrictive element. The magnets, therefore, would have to be copper-clad in order to shield them from being demagnetized by the alternating signal flux. Unfortunately, even large rings of these prior art magnetostrictive materials could not provide displacements great enough to produce useful acoustic power at the lower end of the audio frequency spectrum.

In recent years, much interest in magnetostrictively driven transducers is being shown since the development of the lanthanide series of magnetostrictive materials employing Samarium, Terbium, Dysprosium. One of the best of these lanthanide series materials is Terfenol D ($Tb_{0.3}Dy_{0.7}Fe_2$). These new alloys offer very high magnetostrictive strain capabilities thereby allowing much greater acoustic power output at lower operating frequencies. Unfortunately, these new materials have very low permeabilities and hence are difficult to bias. The prior art method of biasing comprises superimposing an AC drive field onto a DC biasing field using appropriate passive blocking components to separate the AC drive source and the DC power supply. Both sources energize a common solenoid encompassing the magnetostrictive element. The element is commonly fabricated in bar shape with grain orientation along the length of the bar to maximize the strain per unit magnetomotive force applied to the bar. This common solenoid technique for biasing produces heating of the solenoid and the magnetostrictive bar which reduces the power obtainable from the transducer.

It is therefore the object of this invention to eliminate the need for a direct current bias field by utilizing permanent magnets to provide the required biasing of the magnetostrictive elements. Features of the invention include the reduction of coil winding losses, reduction of wiring complexity and the elimination of coupling components which isolate the AC drive from the DC drive resulting in significant simplification of the power driver design.

SUMMARY OF THE INVENTION

The aforementioned problems of the prior art are overcome with other objects and advantages of permanent magnet biasing of magnetostrictive transducers which are provided by magnetic circuitry in accordance with the invention and utilizes permanent magnets which are magnetized to much higher pole strengths that are almost immune to depolarization by alternating flux fields. Samarium-cobalt magnets have these properties. In addition, the shape and relative orientation of the magnets determine the amount of polarizing flux density that may be uniformly distributed throughout the magnetostrictive bar. The cross-sectional area of the magnet ends is preferably the same as the cross-sectional area of ends of the bar so that the stray flux density is kept to a minimum thereby maximizing the uniformity of the flux density within the magnetostrictive bar. The magnets are mounted outside the coil that is used for alternating current energization of the magnetostrictive bar to minimize coupling coefficient losses from eddy currents and inductance leakage which would otherwise be present in greater amounts in the magnets if they were inside the coil.

BRIEF DESCRIPTION OF THE DRAWINGS

The aforementioned aspects and other features, objects, and advantages of the apparatus of the present invention will be apparent from the following description taken in conjunction with the accompanying drawings wherein.

DESCRIPTION OF PREFERRED EMBODIMENTS

Figure 1:
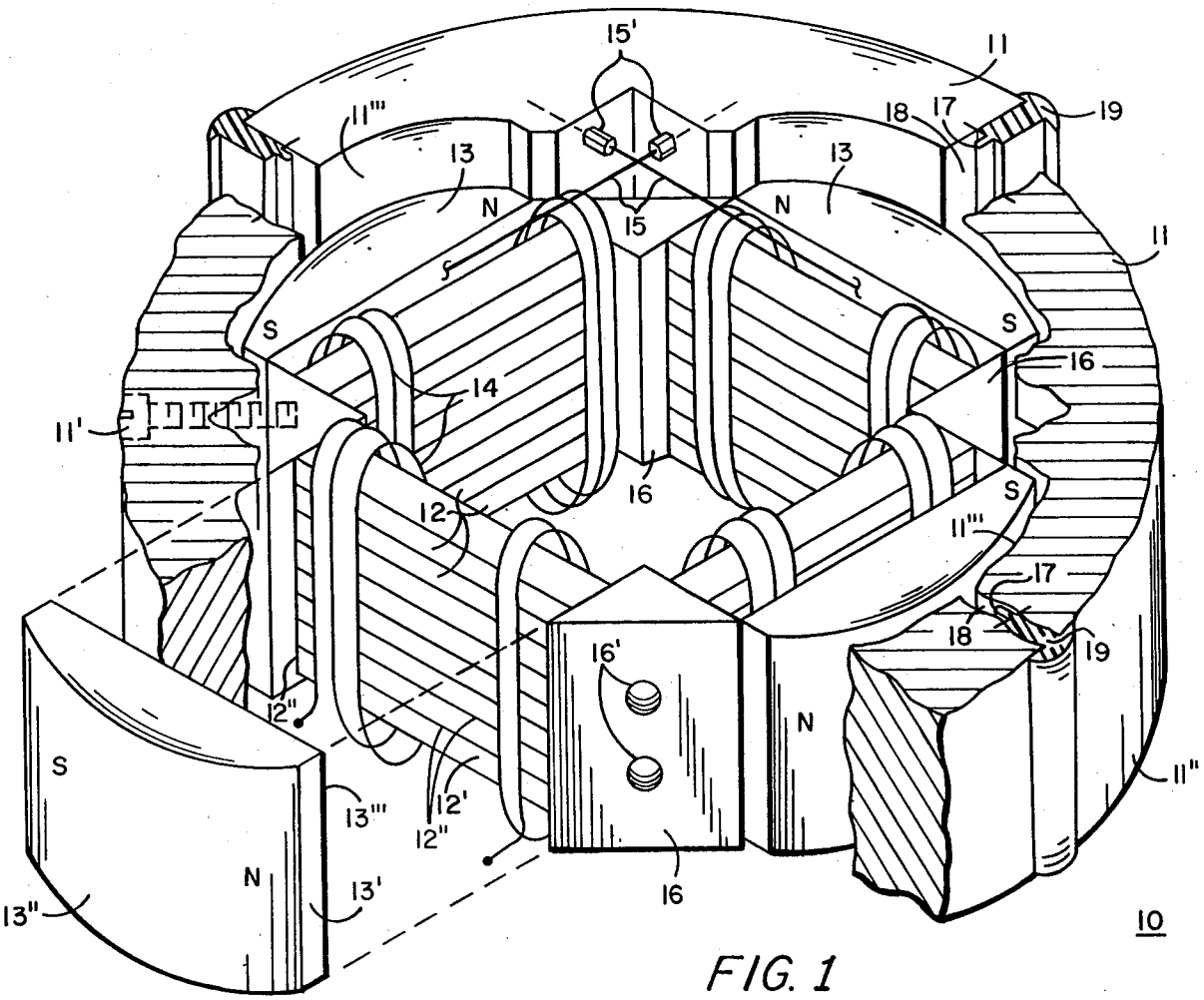
FIG. 1 is an isometric view of a preferred embodiment of the magnetostrictive transducer of this invention.

FIG. 1 shows an isometric view in partial cross-section and in partial exploded view of a preferred embodiment of a transducer 10 of this invention. The transducer 10 comprises radiating masses 11, magnetostrictive bars 12, permanent magnets 13, electrical coils 14, and stress wires 15. The magnetostrictive bars 12 are typically lengthwise grain oriented bars of the lanthanide series of materials of which Terfenol ($Tb_{0.3}Dy_{0.7}$ $Fe_2$) is preferred. Each bar is electrically isolated by insulators 12' from the adjacent bar 12 of the stack of bars 12' in order to reduce the eddy current losses. Each stack of bars 12' has its ends in contact with the corner blocks 16 so that the assembly of the stacks 12' and the corner blocks 16 forms a square. Each stack of bars 12' has an electrical coil or solenoid 14 surrounding it so that alternating current electrical energization of each coil produces an alternating driving field in each stack. The DC biasing flux density for each stack of bars 12' is provided by a magnet 13. Each magnet 13 is adjacent to and outside each coil 14 surrounding each stack of bars 12' which is to be provided with the DC bias magnetic field. The magnets have the property that they can be magnetized to high pole strengths and are almost immune to depolarization by alternating flux fields. Samarium-cobalt magnets have been found to be very satisfactory for producing the DC biasing magnetic flux required by the Terfenol rods 12. These magnets have recoil permeabilities close to that of air as do the Terfenol rods 12. Because of the low permeability of the rods 12, the magnets 13 have like-polarization ends adjacent to each other. The flux from the like-polarity ends of each magnet 13 oppose one another to assist in producing a return flux field on the exterior of the magnet. A portion of the exterior flux of each magnet passes through and along the length of the stack of magnetostrictive bars 12' to the other end of each magnet where the flux path is completed through the magnet. The corner blocks 16 are fabricated from a nonmagnetic material, e.g., stainless steel. The length and height of the magnet 13 is preferably the same as the length and height of the stack of bars 12'. The curved face 13'' of magnet 13 has been found to produce a more uniform field along the length of the stack 12' than other configurations. The curved surface 13'' is preferably a portion of an elliptical surface. The surface 13''' of magnet 13 is flat and, as stated previously, adjacent to the electrical coil 14. It has been experimentally determined for a magnet configuration such as that shown in FIG. 1 that the magnetic flux density at the ends of the bars 12 of stack 12' is about 50 percent greater than the magnetic flux density at the center of the bar. Optimally, the flux density should be constant throughout each bar 12. A non-constant flux density moves the operating point for each portion of the bar along the B-H curve for the magnetostrictive bar thereby reducing the maximum alternating current field (and hence the acoustic power output) which may be applied before saturation occurs. The length of the magnets 13 is preferably equal to the length of each of the bars 12 of a stack 12' to obtain a most uniform longitudinal distribution of flux density throughout the bars 12 of stacks 12'.

The magnets 13 are placed outside the coils 14 in order to reduce the eddy current losses in the magnet 13 produced by the AC field of the coils 14. The radiating masses 11 are attached to corner blocks 16 by screws 11' which are threadedly engaged with holes 16' in the corner blocks 16. The radiating masses 11 each have outer surfaces 11'' which form a quarter of a cylindrical surface so that when all four of said radiating masses 11 are attached to their respective corner blocks 16 the resulting transducer has a cylindrical form. Each radiating mass 11 is elastically connected to a neighboring mass 11 by a spring 17 which spans the gap 18 between the masses 11. The portion of the gap 18 between spring 17 and the exterior surface 11'' is filled with a water seal 19, typically a urethane, which together with a water proof top and bottom flexible cover (not shown) attached to the radiating masses 11 provides a transducer 10 which has a water-proof interior. The covers (not shown) have provision for a cable for supporting the transducer 10 and also for providing electrical access to the interior of the transducer 10. Stress wires 15 are attached by screws 15' between the tops (and bottoms) of adjacent radiating masses 11 and parallel to the stacks of bars 12' to provide compressive stress on the bars 12 and to form the assembly of the transducer 10. The need for compressive stress on the magnetostrictive bars 12 is well known to those skilled in the art, and the details of the use of stress wires 15 to provide this compressive stress is described in detail in U.S. Pat. No. 4,438,509 incorporated herein by reference and made a part hereof. As described in that patent, the tensioning of the stress wire 15 by rotatably attached screws 15' threaded into the radiating masses 11 causes a compressive force on the bars 12 of each stack. The radiating masses 11 are typically of a nonmagnetic material such as aluminum which has the advantage of also being of low mass. The magnets 13 exert a repulsion force on each other and are forced against and held in place by the inner surface 11''' of the radiating means 11.

In operation, the transducer 10 has an alternating voltage applied to each of the coils 14. For unipolar operation of the transducer 10, i.e., where the radiating masses 11 move radially in phase with one another, the electrical coils 14 must be energized so that the AC magnetic flux direction is in phase for each stack of bars 12' relative to the DC flux direction produced by magnets 13 in each stack of bars 12'. Operation of the transducer 10 of FIG. 1 using permanent magnet DC flux biasing is slightly less efficient than that obtained when a direct current through the coil 14 is used to obtain optimum biasing because of the less uniform DC magnetic field produced by the magnets 13.

Figure 2:
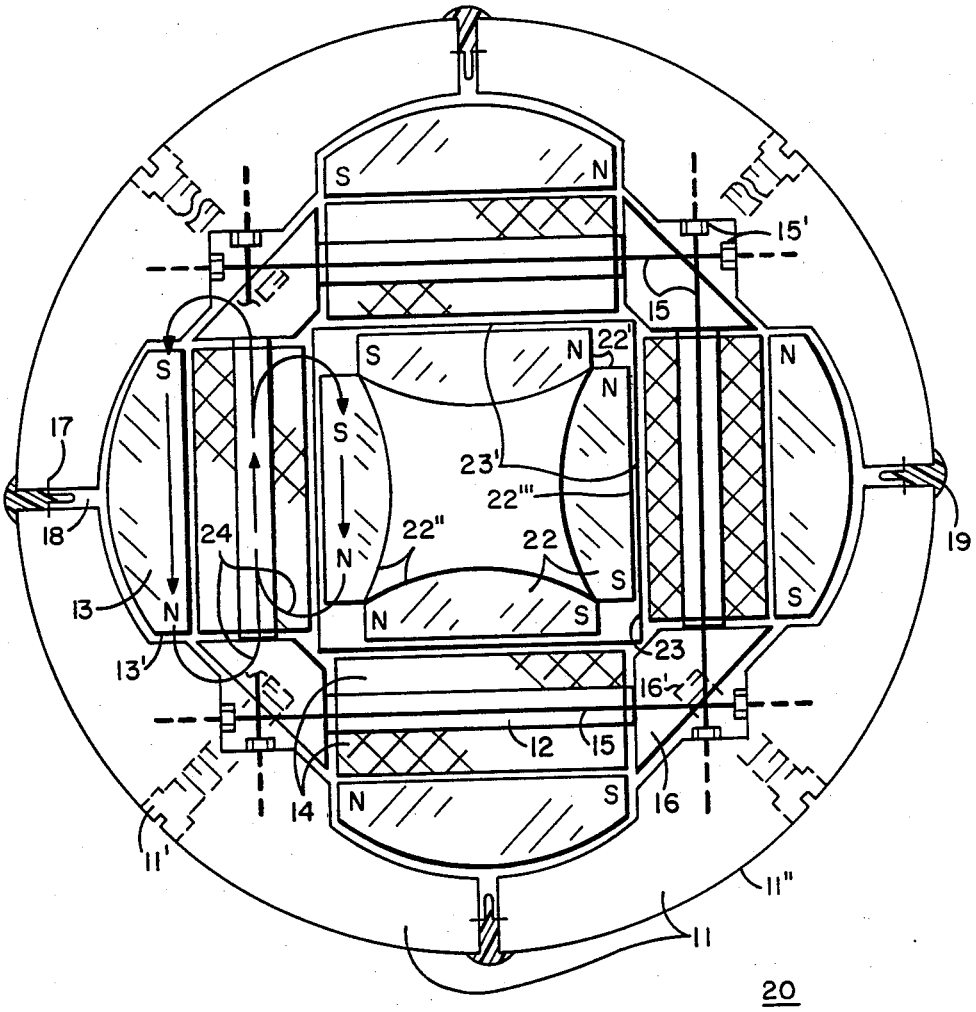
FIG. 2 is a top view of another embodiment of the magnetostrictive transducer of this invention with biasing magnets on the interior portion of the transducer.

FIG. 2 is a top view of another preferred embodiment of a transducer 20 with permanent magnet biasing of the magnetostrictive bars 12. The transducer 20 of FIG. 2 is similar to that transducer 10 of FIG. 1 and the same numbers are utilized as in FIG. 1 to show corresponding parts of the transducer. The transducer 20 of FIG. 2 has, in addition to the elements shown in FIG. 1, a set of inner permanent magnets 22 of the same samarium-cobalt type as used in the transducer of FIG. 1. However, the magnets 22 are placed on the interior portion of the transducer within a nonmagnetic container 23 having at least four opposed walls 23'. Typically, the container is of stainless steel. The container is slightly smaller than the inside perimeter formed by the electrical coils 14, but large enough to contain the magnets 22. Although the magnets 22 are shown in FIG. 2 as touching one another and spaced from the container 23, in actuality because of the opposite polarization of adjacent magnets 22, they will repell one another and be forced by the repulsion force to press against the sides of the container 23. Magnets 13, 22 on opposite sides of the same stack of bars 12' have like-polarity ends adjacent to each other.

It is noted that geometrical constraints on the innermost magnets 22 require that they be shorter than the magnetostrictive bars 12. Inasmuch as the magnetic flux 24 produced by the outer magnets 13 produce greater flux density at the ends than at the center of the magnetostrictive bars 12, the shorter length of the inner magnets 22 helps to provide greater uniformity of flux density within the magnetostrictive bars 12 because the flux produced by the shorter magnets 22 will be greater near the center of the bars than at their extremities. Because each magnetostrictive bar 12 is under the influence of the magnetic field provided by the inner magnet 22 and the outer magnet 13, the magnetic flux of at least the inner magnets 22 may be reduced to provide a more uniform flux density in the magnetostrictive bar 12 which is approximately half of the saturation flux density of each bar 12. The lesser flux density from each magnet may also be accomplished by reducing the area of the ends 13' and 22' of the magnets 13, 22, respectively. Alternatively, the strength to which the permanent magnets 13, 22 are magnetized may be reduced and may differ in order to produce a greater uniformity of flux density along the length of the magnetostrictive bar 12. It is noted that, the inner magnets 22 also have their innermost faces 22'' of eliptical shape with the face 22''' next to coil 14 being flat. The magnets 13 and 22 have the elliptical surface only in the circumferential direction.

As noted earlier, the radiating masses 11, the permanent magnets 13 and the corner blocks 16 are in contact with one another when the screws 11', 15' are tightened to form the transducers 10, 20 of FIGS. 1 and 2, respectively. Even after tightening screws 21, the gap 18 still exists in order to provide space for the changing circumference of the radiating masses 11 when they undergo sinusoidal radial expansion and contraction under the influence of the alternating current in coils 14.

Figure 3:
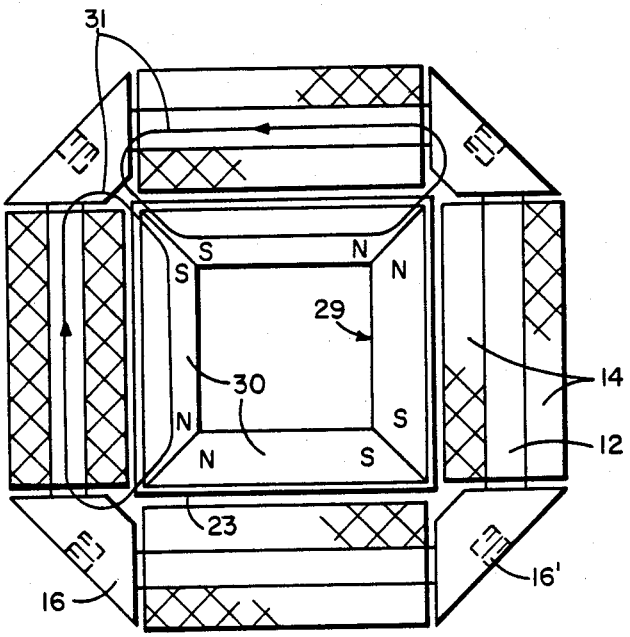
FIG. 3 shows a different form of permanent magnet assembly on the interior portion of the magnetostrictive bars.

FIG. 3 shows a top view of another structure 29 for obtaining DC magnetic biasing of the magnetostrictive rods 12. In FIG. 3, the permanent magnets 30 are trapezoidal and fit inside the container 23 as described earlier. The magnets are forced into the container 23 with like-polarity poles adjacent each other. Their mutual repulsion force causes them to be forced against the side walls of the container 23 and be maintained in that position. A typical flux line 31 produced by the trapezoidal magnets 30 is showh in FIG. 3. The uniformity of flux density in the magnetostrictive bars 12 produced by magnets 30 is sufficient to result in satisfactory operation of a transducer made using trapezoidal magnets 30 without the external magnets 13 of FIGS. 1 and 2. Greater uniformity of flux density in the magnetostrictive bars 12 of FIG. 3 may be obtained by adding permanent magnets 13 to the exterior surfaces of the coils 14, if desired.

Having described a preferred embodiment of the invention, it will now be apparent to one of skill in the art that other embodiments incorporating its concept may be used. For example, different shapes of permanent magnets may provide more uniform fields in the magnetostrictive bars. In addition, the invention may be applied to bias magnetostrictive bars in "Tonpilz" and other types of transducers which do not have the cylindrical form used in illustrating the preferred embodiments. It is felt, therefore, that this invention should not be limited to the disclosed embodiment, but rather should be limited only by the spirit and scope of the appended claims.

What is claimed is:

1. A transducer comprising:

a paramagnetic magnetostrictive material;

a coil for providing an alternating current magnetomotive force to said material;

permanent magnet means providing a magnetic flux density within and along the length of said material;

said magnetic flux density within said material provided by the shape of said permanent magnet means being substantially uniform over the length of said material;

said coil being between said magnetostrictive material and said magnet means;

said magnet means being smaller in transverse area at the ends of said magnet means than at its center and said magnet means being uniformly transversely spaced from said coil along the length of said magnet means; and a mass connected to said magnetostrictive material to produce acoustic energy when said coil is energized with an alternating current to produce said alternating current magnetomotive force.

2. The transducer of claim 1 wherein:

said permanent magnet means is comprised of samarium-cobalt material.

3. The transducer of claim 1 wherein:

said permanent magnet means comprises a magnet having a length dimension in the same direction as said magnetostrictive material; and said magnet being plano-convex with the flat surface adjacent said coil and the convex surface being curved along its length dimension and in the direction of its magnetic field.

4. The transducer of claim 3, wherein said convex surface is a portion of an elliptical surface.

5. The transducer of claim 1 wherein:

said permamanent magnet means is a bar magnet having oppositely polarized ends;

said magnetostrictive material being of substantially the same length as said bar magnet and having ends separated from the ends of said bar magnet by said coil.

6. The transducer of claim 1 wherein:

said magnetostrictive material is comprised of materials from the lanthanide series.

7. The transducer of claim 3 wherein:

said magnetostrictive material is of the composition $Tb_{0.3}\ Dy_{0.7}\ Fe_2$.

8. The transducer of claim 1 wherein:

said permanent magnet means is a plurality of longitudinal bar magnets each having oppositely polarized ends; and said bar magnets being on different sides of said magnetostrictive material with like polarity poles of saids magnets being in proximity to and nearest to one end of said magnetostrictive material.

9. The transducer of claim 8 wherein:

said magnets are on opposite sides of said magnetostrictive material and one of said opposite side magnets is shorter than the other magnet.

10. A transducer comprising:

a first plurality of lanthanide series material composition magnetostrictive bars;

a plurality of coils each providing an alternating current magnetomotive force to each of said bars, said bars having two ends, each bar end being adjacent to an end of a different bar;

a first plurality of permanent magnets each having two ends of opposite polarity;

each of said bars having ends in proximity to the ends of at least one of said plurality of magnets;

each of said coils surrounding a different one of said bars and being between said bar and one of said magnets; and the polarity of adjacent magnet ends being of the same polarity.

11. The transducer of claim 10 wherein:

said first plurality of bars comprises a second plurality of bars within each of said coils;

said bars of said second plurality being electrically insulated from each other.

12. The transducer of claim 10 comprising in addition:

a second plurality of magnets;

each magnet of said second plurality being on the opposite side of each of said coils from that of the magnets of said first plurality and having the same polarity of magnetization relative to the magnetostrictive bar within said coil.

13. A transducer comprising:

a plurality of paramagnetic magnetostrictive bars and a plurality of corner blocks arranged to form a square;

said blocks forming the corners of said square of which said bars form the sides;

a plurality of coils, one of said coils around at least one bar of said plurality of bars forming each of said sides;

a plurality of permanent magnets each having opposite magnetic polarization at its ends;

each of said magnets being adjacent a respective one of said coils and with magnet ends adjacent to one of said corner blocks being of like polarity;

a plurality of radiating masses, each mass of said plurality being secured to its respective one of said corner blocks to form a cylindrical outer surface;

a plurality of stress wires connected between the tops and bottoms of adjacent radiating masses of said plurality to provide a compressive stress on said magnetostrictive bars;

whereby energization of said coils with alternating current causes altenating radial movement of the cylindrical outer surface.

14. The transducer of claim 13 comprising in addition:

a square container having four sides and corners;

at least some of said plurality of magnets being within said container with each corner of said container having magnet ends of the same polarity, said magnets within said container being repulsed by one another to press outwardly upon the walls of said container;

said container being within said plurality of coils.

15. The transducer of claim 15 wherein said container is made of a paramagnetic material.

16. The transducer of claim 15 wherein:

each of said magnets within said container have ends which are bevelled at an angle of forty-five degrees to thereby cause abutting magnets to fill the corner of said square container.

17. The transducer of claim 15 comprising in addition:

the remainder of said plurality of magnets being on the opposite side of said coils from the sides adjacent said container walls, adjacent ends of said remainder of said plurality of magnets being of the same polarity.

18. The transducer of claim 17 in which:

each of said coils are wound around a second plurality of bars, each of said second plurality of bars having ends of like polarity adjacent each other;

said bars of said second plurality being electrically insulated from each other.

19. The transducer of claim 15 wherein:

said magnets of said plurality within said container having ends which form a 45° angle with respect to the walls of said container so that each magnet extends to the corner of said container.

20. The transducer of claim 19 wherein:

said remainer of said plurality of magnets have a length substantially equal to the length of said magnetostrictive bars.

21. The transducer of claim 19 wherein:

said remainder of said plurality of magnets have ends each with an area substantially equal to the area of the ends of said bars within each of said coils.

* * * * *